US006754935B2

(12) United States Patent
Pozgay et al.

(10) Patent No.: US 6,754,935 B2
(45) Date of Patent: Jun. 29, 2004

(54) POWER TOOL HANDLE

(75) Inventors: David Pozgay, Chicago, IL (US); Jonathan Riley, Chicago, IL (US); Roman Slobodkin, Skokie, IL (US); Paul D. Hatch, Chicago, IL (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 10/161,944

(22) Filed: Jun. 4, 2002

(65) Prior Publication Data

US 2003/0221292 A1 Dec. 4, 2003

(51) Int. Cl.[7] ..... B25G 3/00; A45C 13/22

(52) U.S. Cl. ..... 16/422; 16/111.1; 409/182

(58) Field of Search ..... 16/111.1, 110.1, 16/422, 436; 294/29, 33, 31.1, 32; 409/182; 408/241 R; 81/177.4

(56) References Cited

U.S. PATENT DOCUMENTS

| | | | | | |
|---|---|---|---|---|---|
| 3,261,635 | A | * | 7/1966 | Talay | 294/29 |
| 4,707,921 | A | * | 11/1987 | Meyer et al. | 30/296.1 |
| 4,827,567 | A | * | 5/1989 | Beach | 16/422 |
| 4,932,294 | A | * | 6/1990 | Chang | 81/490 |
| 5,031,323 | A | * | 7/1991 | Honsa et al. | 30/276 |
| 5,074,081 | A | * | 12/1991 | Beth et al. | 451/344 |
| 5,265,657 | A | | 11/1993 | Matsumoto et al. | 144/134 D |
| 5,445,479 | A | | 8/1995 | Hillinger | 408/16 |
| 5,558,570 | A | * | 9/1996 | Nakamura et al. | 451/357 |
| 5,640,741 | A | * | 6/1997 | Yano | 16/421 |
| 5,697,456 | A | * | 12/1997 | Radle et al. | 173/162.2 |
| 5,813,805 | A | | 9/1998 | Kopras | 408/241 R |
| D439,122 | S | | 3/2001 | Adler et al. | D8/61 |
| D439,484 | S | | 3/2001 | Adler et al. | D8/69 |
| 6,443,675 | B1 | * | 9/2002 | Kopras et al. | 409/182 |
| 6,506,006 | B2 | * | 1/2003 | Lui et al. | 409/182 |

FOREIGN PATENT DOCUMENTS

| | | | |
|---|---|---|---|
| EP | 1 125 698 A2 | | 8/2001 |
| JP | 1-135484 | * | 5/1989 |
| JP | 7-276261 | * | 10/1995 |

* cited by examiner

*Primary Examiner*—Chuck Y. Mah
(74) *Attorney, Agent, or Firm*—Greer, Burns, & Crain, Ltd.

(57) ABSTRACT

A generally C shaped power tool handle has two ends for releasably engaging the power tool housing, with a gripping portion between the ends. One of the handle ends has a release lever, while the other of the ends has an attachment arm. The release lever has an actuating end operable to detach the handle from the tool housing. Additional power tool handle embodiments are directed to a tool handle that has a gripping layer and a storage compartment in the handle, with a pliable lip in the handle for resisting movement of stored tools.

20 Claims, 6 Drawing Sheets

POWER TOOL HANDLE

FIELD OF THE INVENTION

The present invention is related to power hand tools. More particularly, the present invention is related to handles for power hand tools as well as methods for making power tool handles.

BACKGROUND OF THE INVENTION

Many power tools have handles for holding them when in use. Some power tools have detachable handles. Detachable handles may be desirable for use with a power rotary cutting hand tool, for instance, to be able to hold the tool in different positions. A rotary cutting tool may require significant force to move it about in operation to cut into material such as drywall. Two handed operation and directly gripping the tool housing may therefore be desired. It may be inconvenient, however, to grip the tool housing directly or to use two hands when using the tool to operate in other positions. When using the tool to cut into an overhead surface, for example, it may be useful to have a handle attached to the tool for gripping. Detachable handles are advantageous so that a user may have the option of holding the tool directly by its housing or by the handle.

Although some examples of detachable handles for power tools are known, these examples have problems associated with them. One problem, for example, is that some detachable handles require tools to remove them or are otherwise difficult to attach and remove. Use of tools such as a wrench, pliers, or the like disadvantageously requires time and effort. Although a more easily detachable handle would be desirable, this desirable feature must be balanced against the need to securely attach the handle to minimize the chances of accidental disengagement.

Examples of tool handles having a tool storage compartment are also known. It is convenient to provide for storage of a wrench and the like so that these tools are close at hand when using the power tool. Known handle storage compartments have problems associated with them, however. For example, the tendency of stored tools to move about and rattle in the compartment is disadvantageous.

SUMMARY OF THE INVENTION

An embodiment of the present invention is directed to a detachable handle for a power tool. A detachable handle invention embodiment is generally C shaped, and has opposite end portions with a gripping portion therebetween. A release lever is proximate one handle end portion, and pivots between two lever ends. One of the lever ends is for engaging the tool housing first portion. The detachable handle also has an attachment arm on the other end for engaging another portion of the tool housing.

An additional invention embodiment is directed to a power tool handle having a storage compartment. The tool handle has a gripping portion with a gripping layer thereon, with at least a passage communicating between the gripping portion and the storage compartment. A pliable lip is located in the storage compartment for resisting the movement of a stored tool. The pliable lip is formed of the same material as the gripping layer, and is continuous with the gripping layer through the passage. Yet an additional invention embodiment is directed to a method for making a power tool handle, and comprises steps of forming a gripping layer on a handle exterior surface and forming a pliable lip in a handle interior storage compartment that is continuous through a passage with the gripping layer.

DETAILED DESCRIPTION

Figure 1:
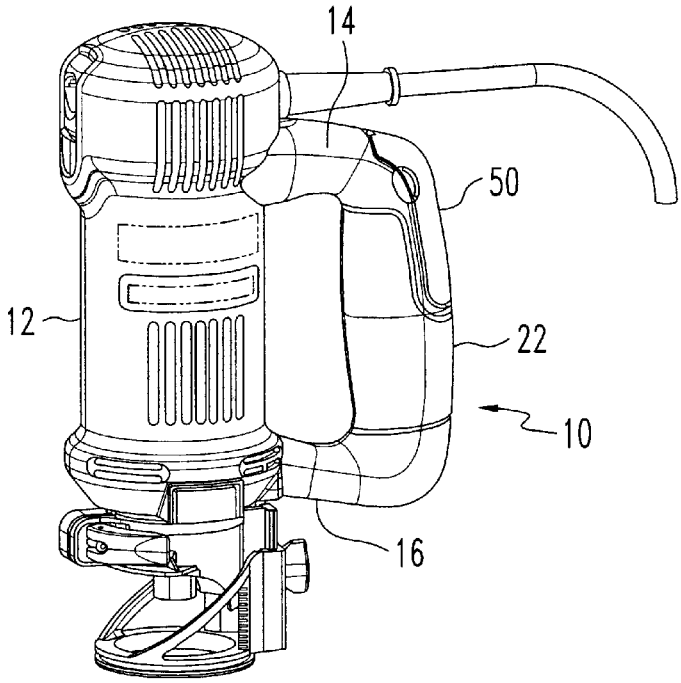
FIG. 1 illustrates a detachable handle embodiment of the invention attached to a power tool.

An embodiment of the invention is directed to a detachable handle for a power hand tool. A handle embodiment of the invention indicated generally at 10 is shown attached to a power tool 12 in FIG. 1, and being attached to the tool 12 in FIG. 2. The detachable handle 10 is generally C shaped, and has ends 14 and 16, respectively, for engaging portions 18 and 20, respectively, of the tool 12 housing, which may contain the tool motor. The handle 10 also has a gripping portion 22 between the ends 14 and 16. Preferably, the handle 10 is made of molded plastic.

Figure 2:
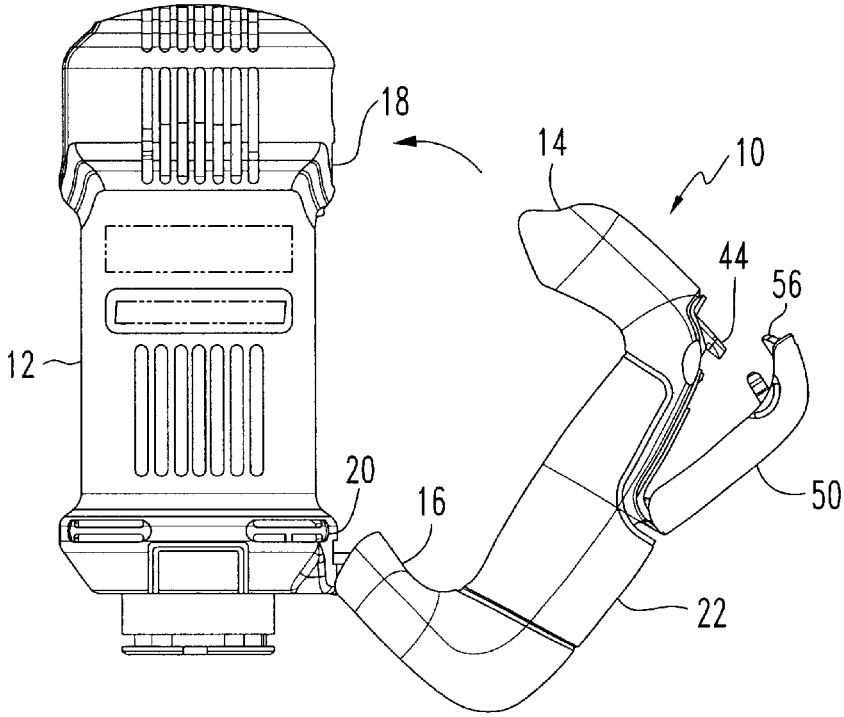
FIG. 2 illustrates the handle embodiment of FIG. 1 being attached to the power tool.

With reference to FIGS. 1 and 2, as well as the remaining drawings, it will be understood that some invention embodiments are directed to a detachable tool handle only, while other invention embodiments may include a power tool as a structural part of the invention. It will also be appreciated that embodiments of the present invention will be useful with different types of power tools. One particular type of tool that has been discovered to be useful in practice of invention embodiments is a rotary cutting tool of the type that has a housing and a motor for driving a rotary cutting bit on a shaft at a relatively high RPM. Artisans knowledgeable in the art will appreciate that these types of tools may be used in a plurality of working positions some of which a handle will be useful for and some of which it may be preferred to grip the housing directly.

Figure 3A:
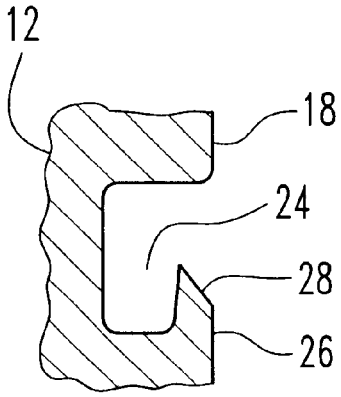
FIGS. 3(*a*) and (*b*) are cross sections of tool housing portions useful for engaging a detachable handle embodiment of the invention.
Figure 3B:
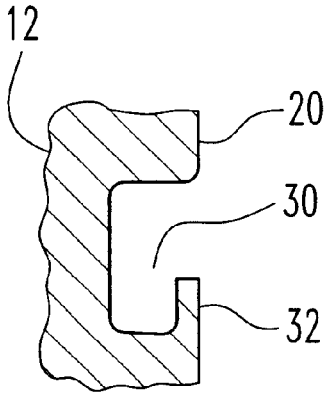

The cross sections of FIGS. 3(*a*) and (*b*) show the tool portions 18 and 20 in detail. FIG. 3(*a*) shows the tool first portion 18 having a recess 24 and a shelf 26. The shelf 26 preferably has a curved lip 28. As illustrated by FIG. 3(*b*), the tool portion 20 is generally similar to the first portion 18 in that it has a recess 30 and a shelf 32. The shelf 32, however, need not have a curved lip like the shelf 26.

Figure 4:
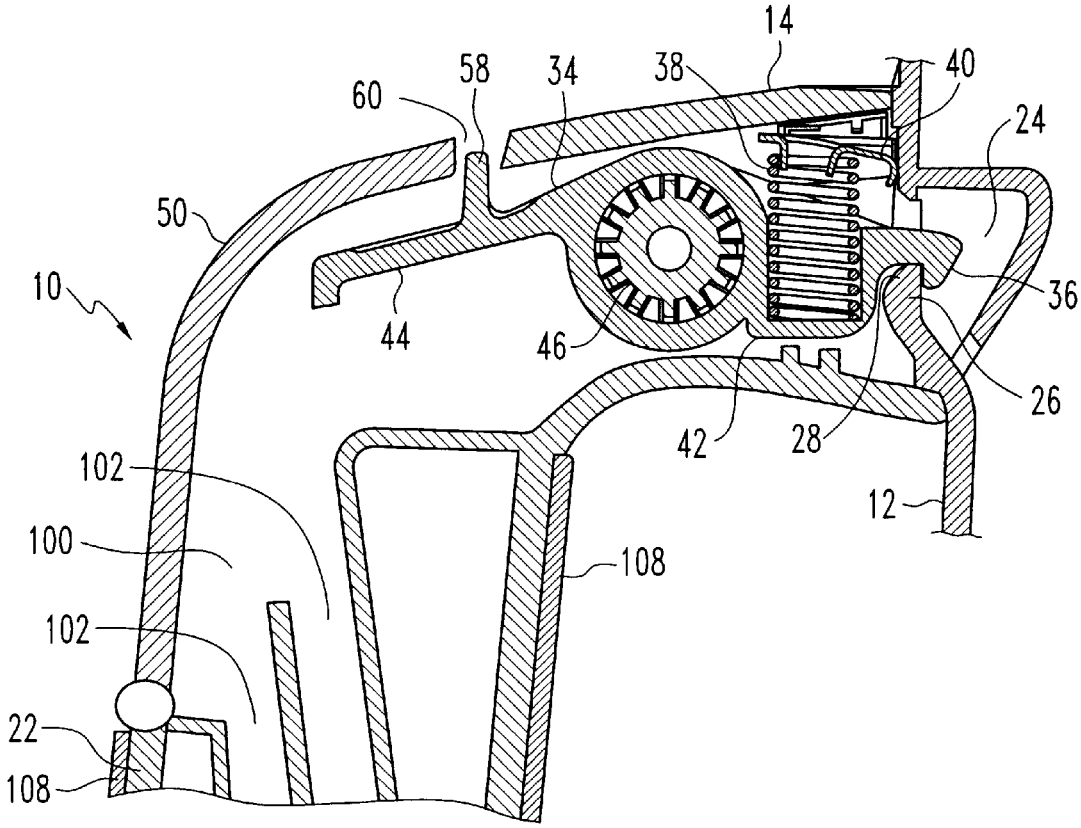
FIG. 4 is a cross section illustrating a release lever of a detachable handle embodiment of the invention.

As best illustrated by the cross section of FIG. 4, the handle 10 has a release lever 34 proximate its end 14 for engaging the tool 12. In particular, the release lever 34 has a hook latch end 36 that enters the recess 24 of the tool portion 18 and engages the shelf 26. A spring means that preferably comprises a compression spring 38 in combination with a leaf spring 40 biases the hook latch 36 towards an engaging position with the shelf 26.

The leaf spring 40 is seated on the handle 10, while the compression spring 38 has a first end seated on the leaf spring 40 and a second end received in a spring cup 42 in the lever 34. Use of a two component spring such as the preferred compression spring 38 and the leaf spring 40 may be desirable to take up tolerances that occur in the manufacture of the plastic handle 10. Those knowledgeable in the art will appreciate that other springs will be useful with embodiments of the invention. By way of example, a leaf spring or a compression spring alone could be used.

Figure 5:
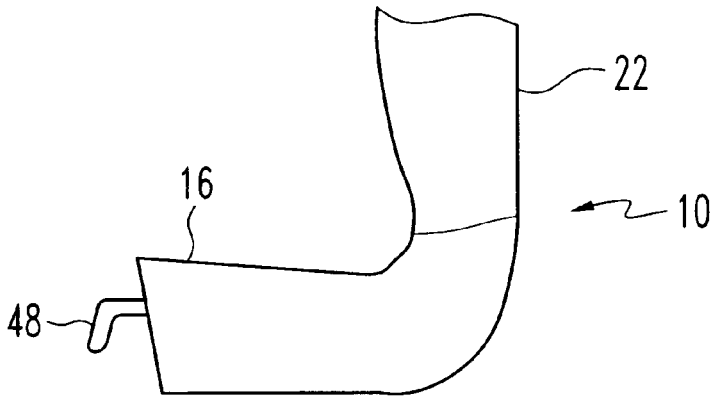
FIG. 5 illustrates a handle embodiment end.

Distal from the hook latch end 36 on the release lever is the actuating end 44. The lever 34 pivots about the boss 46 in the handle 10 interior between the actuating end 44 and the hook latch end 36. Preferably, the lever 34 operates generally in the plane of the C shaped handle 10. That is, movement of the lever ends 36 and 44 during operation occurs generally along the plane of the C shape of the handle 10. Other operating orientations are of course possible, with an example being operation in the plane perpendicular to that of the C shaped handle. FIG. 5 shows the handle end 16 with its attachment arm 48 for engaging the tool portion 20. Unlike the release lever 34, the preferred attachment arm 48 is stationary, and has a generally downward facing L shape to engage the upwardly facing shelf 32 of the tool portion 20.

With reference to FIG. 2, to attach the handle 10 to the tool 12, the attachment arm 48 is first engaged with the shelf 32 of the tool portion 20, and the handle end 14 then urged towards the tool portion 18. With reference now made to FIG. 4 as well as FIG. 2, when the release lever hook latch end 36 with its sloped end contacts the tool shelf 26 while moving in a forward direction, the shelf angled lip 28 urges the sloped latch end 36 upward against the force of the springs 38 and 40. Once the latch end 36 has moved sufficiently forward into the recess 24, the force of the springs 38 and 40 snaps the latch end 36 downward into engagement with the shelf 26 to thereby lock the handle 10 into place with the tool 12. Thus the handle 10 is automatically engageable with the tool 12 without any manual operation of the lever 34 required. No tools such as a wrench or pliers are needed to attach the handle 10 to the tool 12. Further, no manual adjustment of screws, bolts, or even the lever 34 is required, with the handle 10 instead able to be attached simply by engaging the attachment arm 48 with the tool shelf 32, and then urging and the release lever latch end 36 against the tool shelf 26. This is advantageous in that the handle 10 provides for fast and convenient attachment to the tool 12.

During attachment, the snapping under spring force of the lever latch end 36 against the shelf 26 results in an audible "snap." This audible snap is advantageous in that it provides an audible indication of locked engagement of the handle and the tool 12. It is noted that as used herein in this context, the term "audible" is intended to broadly refer to being able to be heard by a typical user in a normal environment. To disengage the handle 10 from the tool 12, the release lever actuation end 44 is operated through a downward pressing by a user's thumb or the like. This action will cause the latch end 36 to rise upwardly against the forces of the springs 38 and 40 and to disengage from the shelf 26. The handle end 14 may then be moved away from the tool 12.

Preferably, the handle gripping portion 22 has an access door 50 that protects the release lever actuating end 44 from accidental operation. Specifically, the access door 50 has an open and a closed position, as shown generally in FIGS. 6 and 7, respectively. The door 50 has a top 52 and a bottom 54, with a hinge provided near its bottom 54 for pivotal attachment to the handle gripping portion 22. A pair of latch clips 56 are on interior of the door 50 along its sides for snap fitting against shoulders in the handle 10 to releasably hold the door in a closed position. Manually pulling on the door 50 when in a closed position causes the clips 56 to disengage from the shoulders so the door 50 may be opened.

The lever actuating end 44 is only accessible when the door 50 is in the open position. This advantageously minimizes the chances of accidental operation of the lever 34 and resultant disengagement of the handle 10 from the tool 12. To disengage the handle 10, a user must perform the two-step process of first opening the access door 50 and subsequently depressing the actuating end 44 of the lever 34. The placement of the access door top 52 and the release lever actuating end 44 proximate the upper end of the handle gripping portion 22 makes this two step operation convenient since a user's thumb is generally near the upper end of the handle gripping portion 22 when holding the handle 10. Thus the two-step release process may generally be accomplished in a one-handed manner.

Figure 7:
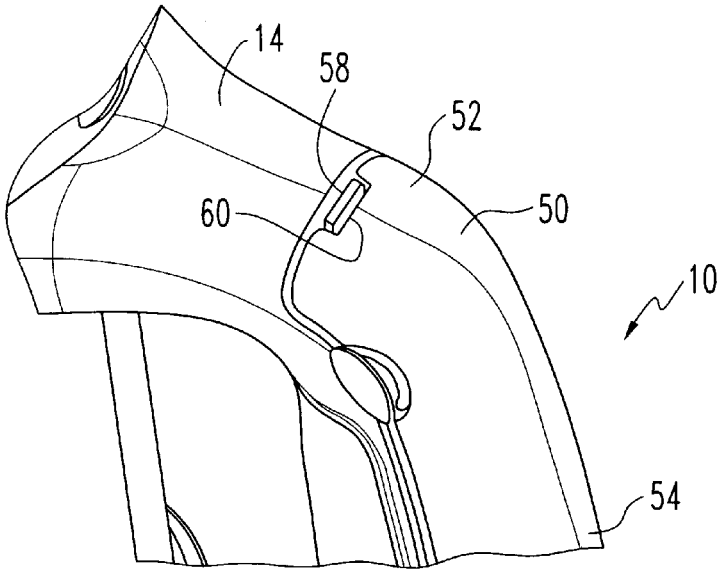
FIG. 7 illustrates an access door of a handle embodiment of the invention.

As best illustrated by FIGS. 4 and 7, the preferred release lever 34 further comprises an indicator protrusion 58 extending upwards near the actuating end 44. The access door 50 has a corresponding cutout 60 that allows for the protrusion 58 to be seen when the door 50 is in a closed position. This is advantageous in that the location of the release lever 34 is thus indicated to a user who may otherwise be unfamiliar with the design of the handle 10. This visible indicator feature may be further enhanced by using contrasting color schemes for the lever indicator protrusion 58 and the handle 10 and access door 50. Use of a red color for the indicator protrusion 58 and black/dark blue for the handle 10 and door 50, for instance, may enhance the visibility of the protrusion 58.

Figure 6:
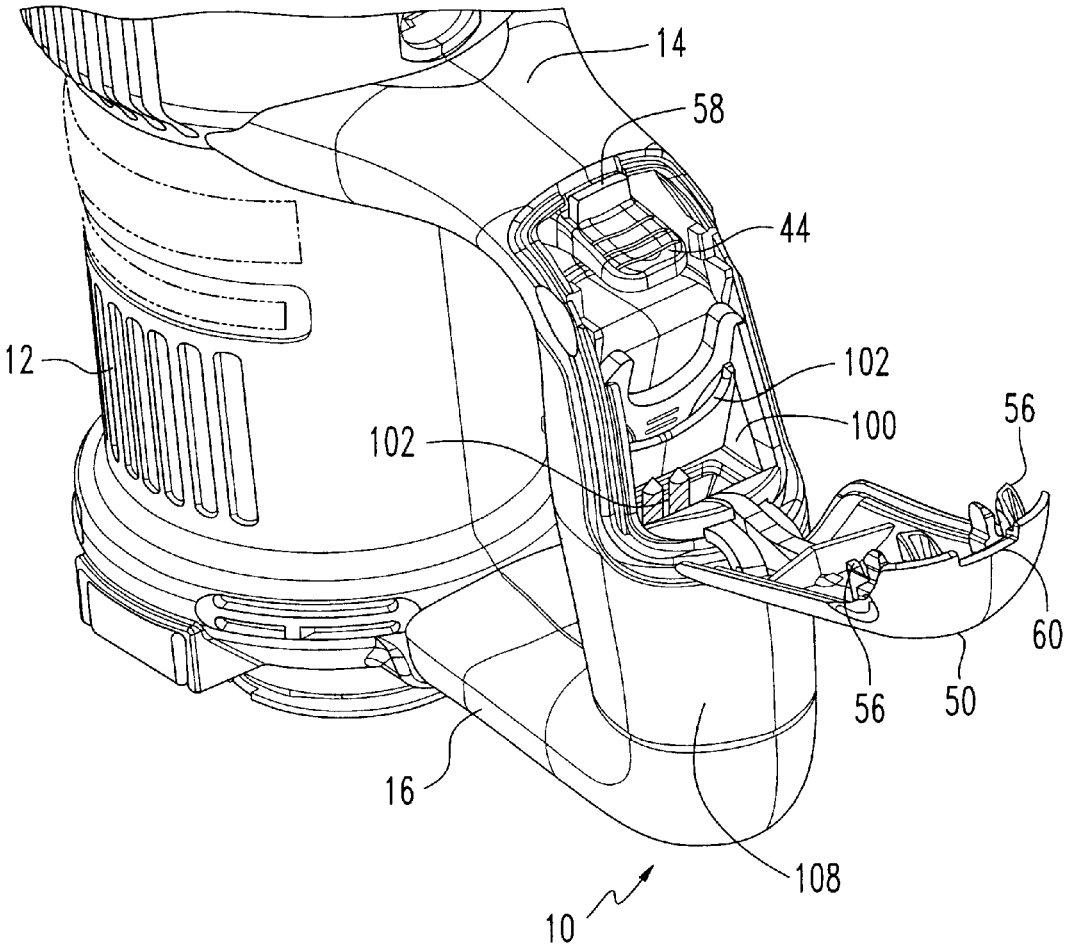
FIG. 6 illustrates a storage compartment of a handle embodiment of the invention.
Figure 8:
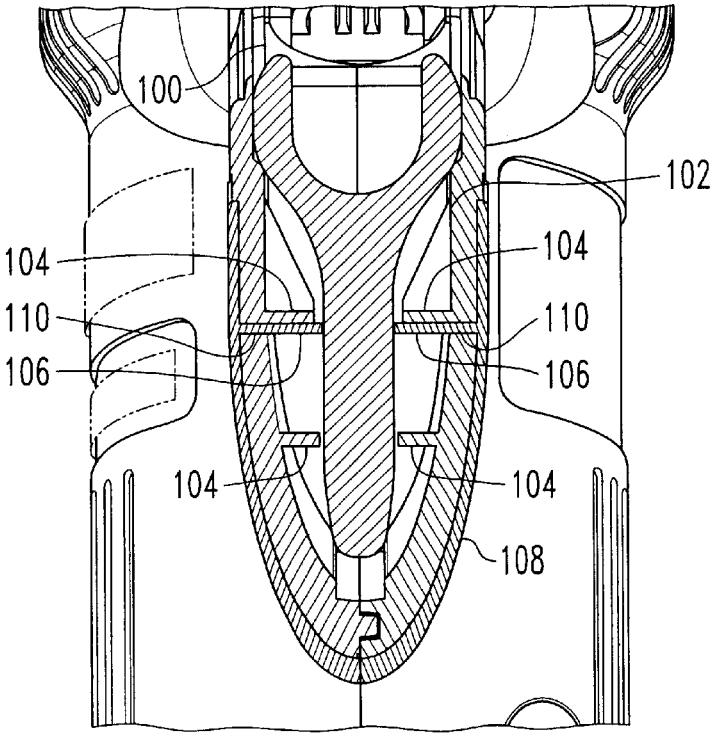
FIG. 8 is a cross section of a portion of a handle embodiment of the invention showing a tool storage slot.

The preferred handle 10 also has a storage compartment in its interior for storing tools and the like. Specifically, a storage compartment 100 is in the interior of the gripping portion 22 of the handle 10. At least a top portion of the storage compartment 100 is accessible when the access door 50 is in an open position. As best shown by FIGS. 6 and 8, the storage compartment 100 has at least one, and preferable a plurality of storage slots 102 for storing tools. The slots 102 may extend generally coaxially with the handle gripping portion 22. The tool slots 102 may be useful, for instance, to keep tools such as a wrench and bits close at hand when using the power tool 12.

At least one of the slots 102 is preferably configured for storing a tool having an elongated portion such as a handle. The cross section of FIG. 8 shows, for instance, a wrench being stored in one of the tool slots 102. As illustrated, the slot 102 preferably comprises a plurality of bracket arms 104 for engaging the stored wrench elongated handle. Preferably, the bracket arms also have a pliable lip 106 on them for resisting movement of the stored tool. Preferably the pliable lips 106 extend from the bracket arm 104 less than about 1 mm into the slot 102, and most preferably about 0.5 mm. The pliable lip 106 may comprise, for example, a rubber or a thermoplastic. Preferably, the pliable lip is comprised of a thermoplastic elastomer. An example of a most preferred material includes that known in the trade as monoprene thermoplastic elastomer. The pliable lip 106 is advantageous in that it reduces the tendency of the stored tool to otherwise move and rattle as the handle 10 is moved about. Other invention embodiments may comprise a plurality of pliable lips 106 in locations as may be desired. For example, substantial portions or all of the interior walls and floor of the slots 102 may be covered with a pliable lip 106.

Preferably, at least part of the exterior surface of the handle gripping portion 22 has a gripping layer 108 thereon.

The gripping layer 108 is preferably made of a material that provides for a comfortable and slip resistant grip of the handle 10. Preferred materials include rubbers and thermoplastics such as a rubber-like elastomer. Examples of most preferred materials include thermoplastic elastomers, with a particular example known in the trade as monoprene thermoplastic elastomer. The gripping layer preferably has a thickness of between about 1 and about 3 mm.

In a most preferred handle 10, the gripping portion pliable layer 108 is continuous with the tool slot pliable lip 106 through at least one passage 110 extending through the handle wall 111 to communicate between the gripping layer 108 and the slot lip 106. It has been discovered that these preferred passages 110 provide for desirable advantages in the manufacture of the most preferred handle 10 for forming the pliable lips 106 in the tool slots 102. For example, when applying thermoplastic elastomer or the like to the gripping portion 22 exterior surface to form the gripping layer 108, the passages 110 allow for the elastomer to flow into the interior tool slot 102 to form the pliable lip 106. Also, the passages 110 may provide for improved attachment of the gripping layer 108 and the pliable lips 106 to the handle 10 and thereby reduce or eliminate the need for adhesives.

The number and location of the passages 110 may be provided as desirable to form the pliable lips 106 in selected numbers and locations. The passages 110 are preferably placed proximate to locations in which pliable lips 106 are desired. The size of the passages 110 should be large enough to accommodate flow of sufficient material between the gripping layer 108 and the lips 106 during a molding process. Also, larger passages may be advantageous to provide for stronger attachment of the gripping layer 108 to the handle 10.

It will be understood that some invention embodiments are directed to a tool handle that comprises a storage compartment as generally described herein, but that is not detachable from the tool and is instead permanently attached. That is, an additional invention embodiment comprises a tool handle having a storage compartment as described herein with reference to the compartment 100 and the pliable lips 106 that are continuous with the pliable gripping layer 108 through one or more handle passages 110, but that is not detachable from the tool 12. It will be appreciated that although element numbers have been used that are consistent with a detachable handle, the discussion made herein directed to the storage compartment and pliable lip features of an invention embodiment also describe these alternate permanently attached handle embodiments.

The permanently attached handle embodiments will be understood to be a handle generally consistent in many respects with the tool handle 10 as discussed herein and shown, for instance, in FIGS. 1, 6 and 7, except that it is not removable from the power tool 12. Thus no release lever 34 or attachment arm 48 are required. Those knowledgeable in the art will appreciate that fixed, non-detachable connection of the handle to the tool may be accomplished in a number of ways, with integral molding, heat bonding, adhesive, screws and the like being some examples of permanent attachment means.

Tool handle embodiments of the present invention thereby offer many advantages and solve many problems of the prior art. For example, an invention embodiment provides a detachable handle that may be easily attached and removed from a power tool without the use of tools or the adjustment of bolts or the like. Attachment is secure, and is confirmed by an audible snap. The chances of accidental disengagement are minimized through use of a two-step disengagement process. A handle invention embodiment of the invention also provides a storage slot for storing tools that has a pliable lip for resisting movement of the stored tool to reduce the tendency of the tool to rattle or move about. Those knowledgeable in the art will appreciate that tool handle embodiments of the present invention also provide additional advantages and solve still other problems of the prior art.

Figure 9:
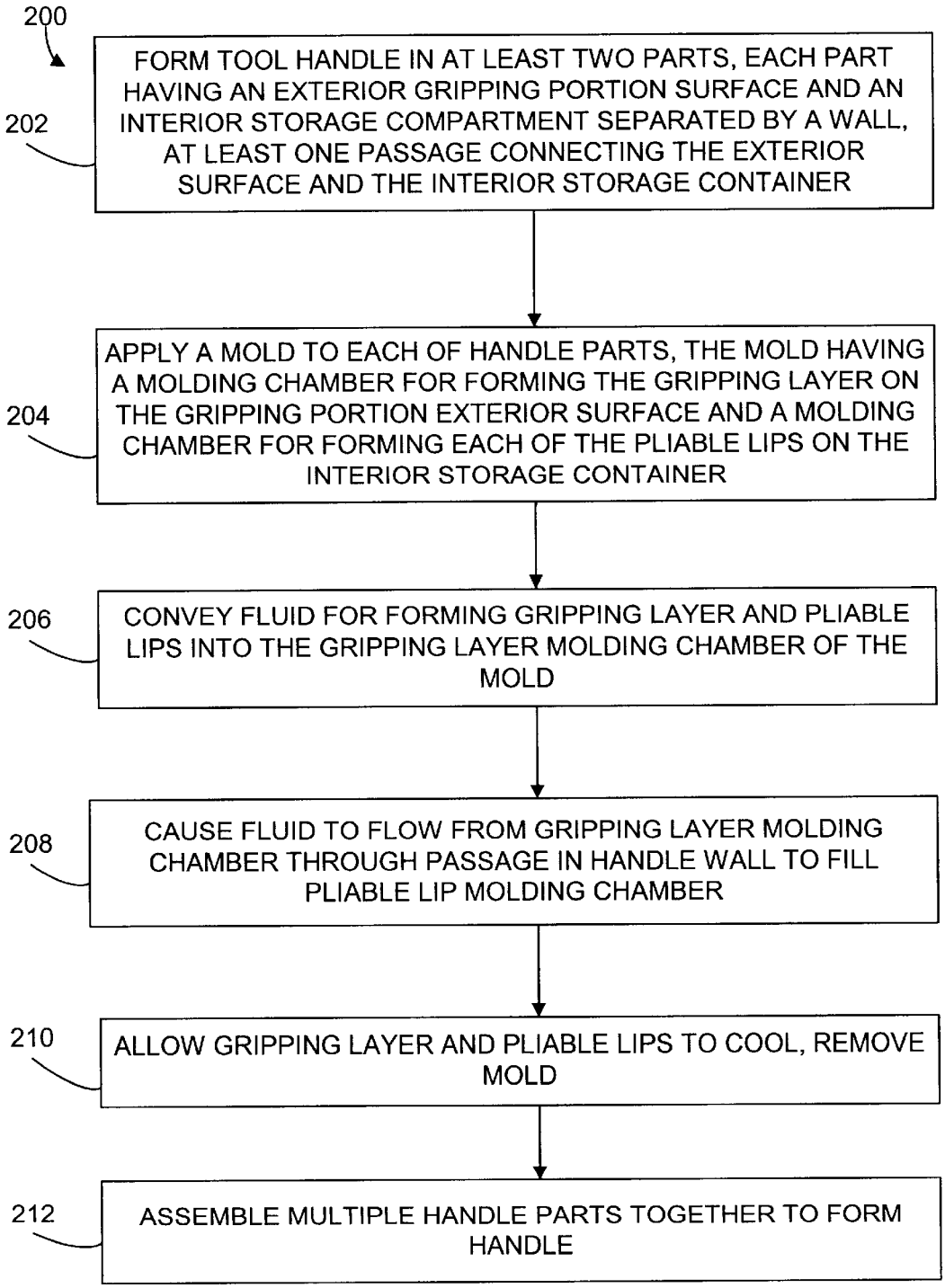
FIG. 9 is a flowchart illustrating steps of a preferred method embodiment of the invention.

Still another embodiment of the invention is directed to a method for making a power tool handle having an interior storage compartment. FIG. 9 is a flowchart illustrating a preferred embodiment of the method of the invention. In considering methods of the invention, it will be appreciated that the methods may be used to make tool handles of the invention. Accordingly, it will be understood that some aspects of the methods may be illustrated through consideration of the handle 12 of the invention. For example, some preferred materials of construction and preferred dimensions associated with elements of the handle 12 as illustrated in FIG. 8 will be applicable to steps of methods of the invention. Accordingly, in describing a method of the invention, reference to elements of FIG. 8 may be made for further illustration of the method steps.

Referring now to FIG. 9 as well as FIG. 8, the method embodiment indicated generally at 200 comprises an initial step of forming a power tool handle having a gripping portion 22 with an exterior surface and an interior storage compartment 100 (block 202). The step of forming the handle includes forming at least one passage 110 that communicates through the handle wall 111 between the exterior surface and the interior storage compartment 100. Preferably, the handle is formed in at least two separate parts that will be joined together to form the handle.

In a subsequent step, a mold is applied to each of the handle parts to form a gripping layer 108 on the gripping portion 22 exterior surface and to form at least one pliable lip 106 in the storage compartment 100 (block 204). The mold defines a molding chamber for forming the gripping layer 108 as well as a molding chamber for forming each of the storage compartment pliable lips 106. The mold may comprise a plurality of individual parts or sections. Preferably, a plurality of pliable lips 106 are formed, and most preferably they extend into the storage compartment 100 from bracket arms 104 for engaging a stored tool or the like. It will be appreciated that other method embodiments may comprise forming pliable lips that are substantially larger than those illustrated in FIG. 8, and that, for example, cover a substantial portion or all of the walls of a handle storage compartment.

The material used to form the gripping layer 108 as well as the pliable lips 106 is conveyed into one of the mold chambers, preferably the gripping layer molding chamber, from an external source (block 206). As will be understood by those knowledgeable in the art, the material is preferably conveyed in a flowing fluid form, and may be at an elevated temperature and pressure. One or more gates may exist in the molding chamber for allowing the fluid to enter. Preferably the material comprises a thermoplastic elastomer, with an example of a most preferably material being that known as monoprene in the trade.

The material in fluid form is then caused to flow from the gripping layer molding chamber through the passage 110 to the pliable lip molding chamber on the other side of the handle wall 111 (block 208). Those skilled in the art will appreciate that causing the fluid to flow through the passage may require steps as are known in the art for inducing fluid flow, such as applying a pressure differential to the fluid across the passage, allowing for venting from one or both of the molding chambers, and the like. After the fluid has filled the molding chambers, it is solidified through cooling or other steps to its final solid, rubber-like state, and the mold is removed (block 210). The gripping layer 108 and pliable lips 106 are thus formed, and are continuous with one another through the passages 110 that communicate between them. In a final method step, the separate handle parts are assembled to form a tool handle (block 212).

Method embodiments of the invention thereby provide advantages and solve otherwise unresolved problems of the prior art. For example, forming of the gripping layer and the pliable lips can be accomplished using a multi-chamber mold while only conveying fluid into one of the molding chambers. Cost savings may thereby be achieved. Additionally, the gripping layer and the pliable lips are tightly held to the power tool handle because they are continuous with one another through the passages connecting them. Required use of adhesives is thereby reduced or eliminated.

It will be appreciated that although discussion and description has been made herein of particular tool handle embodiments and a method embodiment for making a tool handle, such treatment has been made only to illustrate the invention. Other invention embodiments and equivalents to various features of the invention as described will be apparent to knowledgeable artisans.

Various features of the invention are set forth in the attached claims.

What is claimed is:

1. A detachable handle for engaging a power tool, the power tool having a housing, the detachable handle comprising:

a generally C shaped body having a first and a second end and a gripping portion therebetween;

a release lever proximate said body first end having an actuating end and an a lever end opposite from said actuating end, said lever end configured to engage a first portion of the tool housing when said release lever pivots; and, an attachment arm on said body second end for engaging a second portion of the tool housing.

2. A detachable handle as defined by claim 1 wherein the power tool first portion comprises a first recess having a shelf, the second portion comprises a second recess having a shelf, wherein said attachment arm is fixed, and wherein the handle is attached to the power tool by first engaging said handle attachment arm on the shelf of the tool second recess and subsequently driving said release lever against the first recess shelf whereby said release lever engages the first recess shelf and an audible sound results when said lever lockingly engages said first recess shelf.

3. A detachable handle as defined by claim 1 wherein the handle may be attached to the tool without manual operation of said release lever actuating end, and wherein manually depressing said release lever actuating end when the handle is attached to the tool housing causes said lever end to disengage from the tool housing first portion.

4. A detachable handle as defined by claim 1 wherein said release level is configured to automatically lockingly engage the first portion of the tool housing without manual operation of said release lever.

5. A detachable handle for engaging a power tool, the power tool having a housing, the detachable handle comprising:

a generally C shaped body having a first and a second end and a gripping portion therebetween;

a release lever proximate said body first end having a lever end for engaging a first portion of the tool housing;

an attachment arm on said body second end for engaging a second portion of the tool housing; and, wherein the tool housing first portion comprises a first recess having a shelf, and the handle further comprises a spring means for urging said release lever into engagement with the shelf of the first tool housing recess.

6. A detachable handle as defined by claim 5 wherein said release lever further comprises a spring cup for receiving at least a portion of said spring means.

7. A detachable handle as defined by claim 5 wherein said spring means comprises a leaf spring in combination with a compression spring.

8. A detachable handle as defined by claim 7 wherein said release lever has a spring cup, wherein the power tool handle has an interior, a boss in said handle interior, said release lever pivoting about said boss, said leaf spring seated on a wall of said handle interior, a first end of said compression spring engaging said leaf spring, a second end of said compression spring received in said spring cup.

9. A detachable handle for engaging a power tool, the power tool having a the detachable handle comprising:

a generally C shaped body having a first and a second end and a gripping portion therebetween, said gripping portion having an access door movable into an open and a closed position;

a release lever proximate said body first end having a latch end for engaging a first portion of the tool housing and having an actuating end proximate said handle gripping portion and operable to release said latch end from the tool first portion, said release lever actuating end accessible only when said access door is in said open position; and, an attachment arm on said body second end for engaging a second portion of the tool housing.

10. A detachable handle as defined by claim 9 wherein said release lever actuating end has an indicator protrusion, wherein said access door has a cutout, and wherein said indicator protrusion is visible through said access door cutout when said access door is in said closed position.

11. A detachable handle as defined by claim 9 wherein said gripping portion has an upper end, wherein said access door has a top and a bottom, said access door top proximate said gripping upper end, said access door bottom hingedly attached to said handle gripping portion whereby said access door may be opened by a user's thumb operating said access door top proximate said gripping portion upper end.

12. A detachable handle for engaging a power tool, the power tool having a housing, the detachable handle comprising:

a generally C shaped body having a first and a second end and a gripping portion therebetween;

a release lever proximate said body first end having a lever end for engaging a first portion of the tool housing;

an attachment arm on said body second end for engaging a second portion of the tool housing; and, a biasing means for biasing said lever into a tool engaging position, said biasing means able to be overcome to move said into a disengaging position through manual operation of said lever.

13. A detachable handle as defined by claim 12 wherein said biasing means comprises at least one spring, and wherein said lever has a first end distal from an actuating end, said first end for engaging the tool and said actuating end operable to overcome said bias to move aid lever into said disengaging position.

14. A detachable handle for engaging a power tool, the power tool having a housing, the detachable handle comprising:

a generally C shaped body having a first and a second end and a gripping portion therebetween;

a release lever proximate said body first end having a lever end for engaging a first portion of the tool housing;

an attachment arm on said body second end for engaging a second portion of the tool housing; and, wherein the handle further comprises a storage compartment having a tool storage slot, said tool storage slot having a pliable lip for engaging a stored tool to resist movement of the stored tool.

15. A detachable handle as defined by claim 14 wherein said tool slot is for storing a tool having a elongated portion, and wherein said tool slot comprises at least one bracket arm for engaging the stored tool elongated portion, and wherein said pliable lip is connected to said bracket arm.

16. A detachable handle as defined by claim 14 wherein at least a portion of said handle gripping portion has a gripping layer thereon, and wherein the handle further comprises at least a passage communicating between said at least a portion of said handle gripping portion and said tool storage slot, said pliable lip in said tool storage slot continuous with aid gripping layer through said at least a passage.

17. A detachable handle as defined by claim 16 wherein said at least a passage comprises a plurality of passages.

18. A detachable handle as defined by claim 16 wherein said gripping layer on said gripping portion and said tool slot pliable lip are comprised of a thermoplastic elastomer.

19. A detachable handle as defined by claim 14 wherein said storage compartment has a plurality of individual tool slots.

20. A detachable handle for engaging a power tool, the power tool having a housing with first and second portions, the first portion having a first recess with a shelf with an angled lip, the second portion having a second recess with a shelf, the detachable handle comprising:

a generally C shaped body having a first and a second end and a gripping portion therebetween;

a release lever proximate said body first end having a hook latch with a sloped end for engaging the angled lip of the first recess shelf;

a spring for urging said release lever towards an engaging position and; and, a fixed attachment arm on said body second end for engaging a second portion of the tool housing wherein the detachable handle is attached to the power tool by first engaging said handle fixed attachment arm on the shelf of the tool second recess and subsequently driving said release lever against the first recess shelf to cause said release lever to initially move out of said engaging position as the shelf angled lip forces said hook latch sloped end upwards, subsequently causing said hook latch to snap into engagement with the first recess shelf, with an audible sound resulting from said hook latch striking the first recess shelf.

* * * * *

UNITED STATES PATENT AND TRADEMARK OFFICE

CERTIFICATE OF CORRECTION

PATENT NO. : 6,754,935 B2
APPLICATION NO. : 10/161944
DATED : June 29, 2004
INVENTOR(S) : Pozgay et al.

It is certified that error appears in the above-identified patent and that said Letters Patent is hereby corrected as shown below:

Column 7, line 62, delete “level” and insert --lever--.

Column 8, line 28, after “a” insert --housing,--.

Column 9, lines 5 and 33, delete “aid” and insert --said--.

Signed and Sealed this

Eighth Day of May, 2007

JON W. DUDAS
*Director of the United States Patent and Trademark Office*